United States Patent [19]

Cathey

[11] 4,047,754

[45] Sept. 13, 1977

[54] TABLE

[76] Inventor: Jimmy D. Cathey, 1105 Baythorne Drive, Shreveport, La. 71107

[21] Appl. No.: 603,617

[22] Filed: Aug. 11, 1975

[51] Int. Cl.[2] ..... A47B 37/04

[52] U.S. Cl. ..... 297/157

[58] Field of Search ..... 297/157, 174; 108/157

[56] References Cited

U.S. PATENT DOCUMENTS

| | | | |
|---|---|---|---|
| 2,722,971 | 11/1955 | Gallagher et al. | 297/157 |
| 2,800,379 | 7/1957 | Smithers | 297/157 |
| 2,805,708 | 9/1957 | Bohn | 297/157 |
| 2,849,053 | 8/1958 | Beller et al. | 297/159 |
| 2,964,368 | 12/1960 | Heyer | 297/157 |
| 3,134,625 | 5/1964 | Bliss | 297/157 |
| 3,348,879 | 10/1967 | Merola | 297/157 |
| 3,574,393 | 4/1971 | Hughes | 297/157 |

*Primary Examiner*—Roy D. Frazier
*Assistant Examiner*—Darrell Marquette
*Attorney, Agent, or Firm*—John M. Harrison

[57] ABSTRACT

An all metal table, the legs of which support both the top and bench sections and are formed in three bends consisting of 35°, 90° and 100° angles, respectively. The table top and benches are constructed of a metal frame and metal sheeting is riveted onto the frame to form the top and bench surfaces.

8 Claims, 8 Drawing Figures

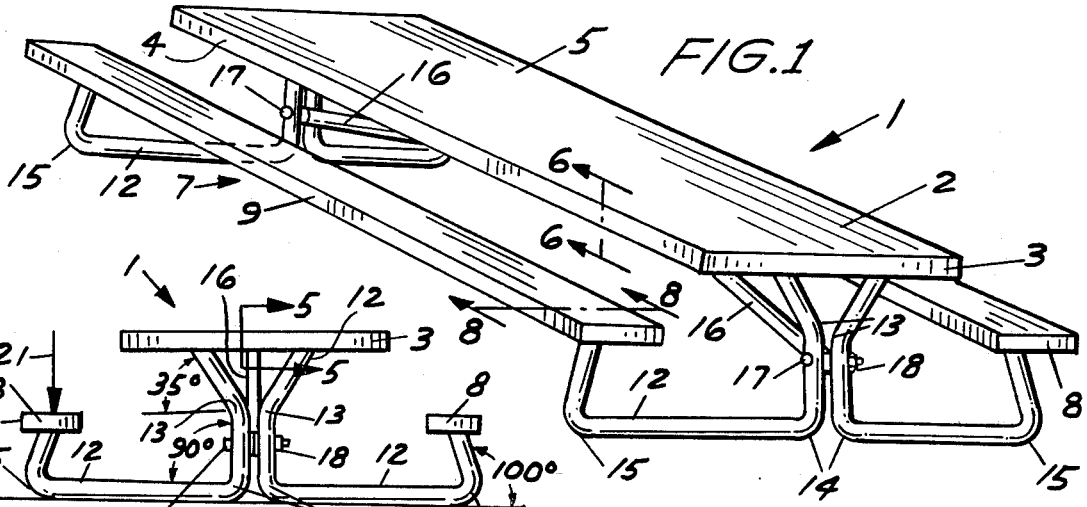
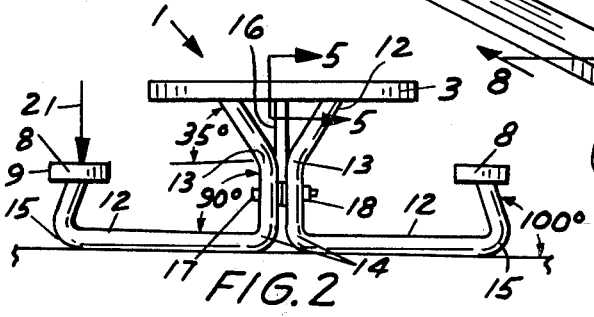
FIG.2
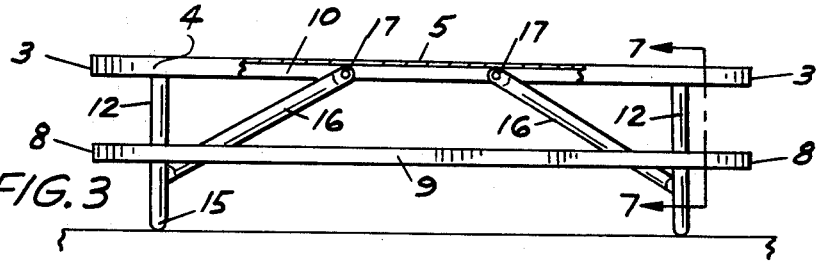
FIG.3
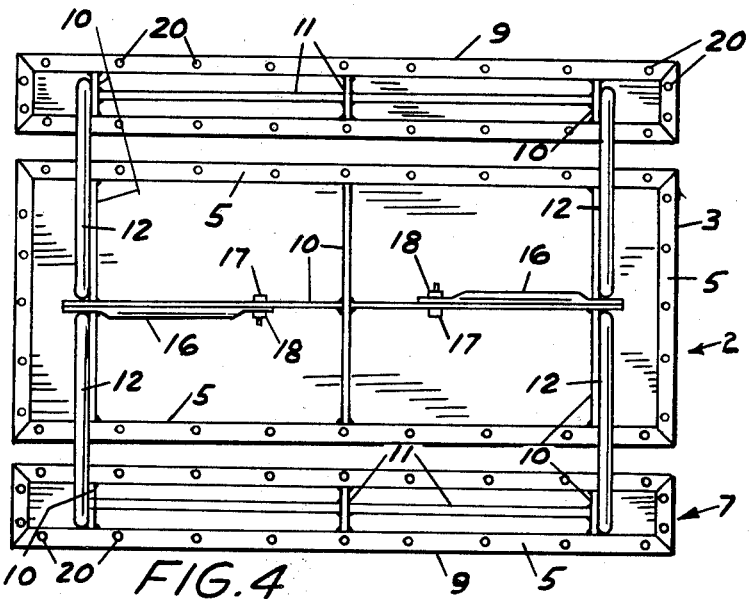
FIG.4
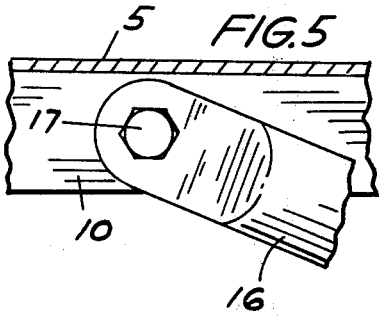
FIG.5
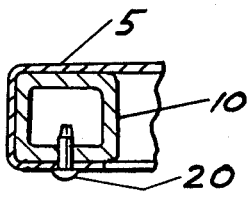
FIG.6
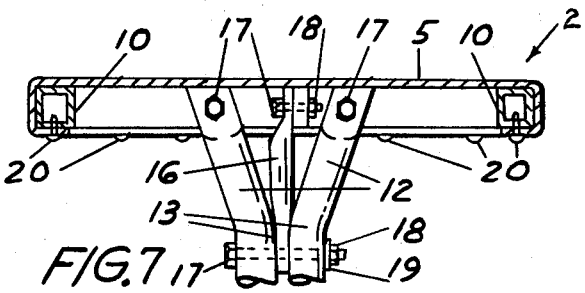
FIG.7
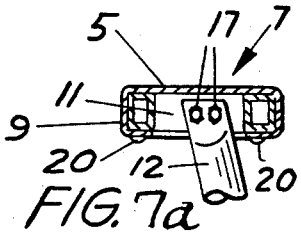
FIG.7a

TABLE

BACKGROUND OF THE INVENTION

1. Field of the Invention

This invention relates to portable tables, and more particularly, to metal tables having a rigid frame and tubular legs formed at specific angles to provide maximum strength, stability and lightness of weight. The table and bench combination is carried by a common set of legs and is braced from table top to the legs by tubular brace members.

2. Description of the Prior Art

Tables having a common leg system supporting both the top and bench sections have long been known in the art. For example, in U.S. Pat. No. 2,722,971 to H. M. Gallagher, et al, and in U.S. Pat. No. 2,805,708 to G. W. Bohn, such tables are disclosed. However, these and similar tables have typically been subject to the disadvantage of low structural integrity under heavy load, and the dangerous susceptibility of tipping when weight is placed on one side without providing a counter balancing weight on the opposite side of the table. For example, in the patent to G. W. Bohn, referring to FIGS. 1 and 2 of the drawing, if several people sat on one side of the table with no counterbalancing weight on the opposite side the table would tip and could cause injury to those seated. This is so because a moment is created around the point where the leg system touches the ground on the outside extremity of the legs when weight is placed on the seat at the outer end.

Accordingly, it is an object of this invention to provide a table which can be used both indoors and outdoors, and which is light, structurally strong and which avoids the dangerous problem of tipping when a load is placed on one bench without a counterbalancing load on the opposite bench.

Another object of this invention is to provide an all metal table which consists of a metal frame and sheeting which resist corrosion and which is structurally sound to enable carrying heavy loads.

A still further object of the invention is to provide an all metal table which is constructed of a metal frame and tubing and which is light in weight, and yet structurally strong, and which retains its stability when point loaded.

Yet another object of the invention is to provide a table having legs formed at specific angles which enables the table to withstand point loads on the benches without tipping, and without the necessity of equalized loading.

A still further object of the invention is to provide a new and improved metal table having a top and benches constructed of metal frames and metal sheeting, respectively, and a common set of tubular legs formed in three angles which effect maximum strength, stability and lightness of weight.

SUMMARY OF THE INVENTION

These and other embodiments of the invention are provided in a table having a top, a pair of benches and common legs supporting the top and benches, which legs are bent at specific angles to provide maximum strength and to permit point loading of the benches without the necessity of counterbalancing loads to prevent the table from tipping. The table top and benches are formed of metal frames covered by metal sheeting preferably riveted to the underside of the frame members.

BRIEF DESCRIPTION OF THE DRAWINGS

The invention will be better understood in view of the following description presented with reference to the accompanying drawings.

FIG. 1 of the drawing is a perspective view of the table of this invention;

FIG. 2 is a right end elevation of the table illustrated in FIG. 1;

FIG. 3 is a front elevation of the table illustrated in FIGS. 1 and 2, partially in section;

FIG. 4 is a bottom elevation of the table illustrated in FIGS. 1-3;

FIG. 5 is a detail of a preferred technique for mounting the braces for the legs of the table;

FIG. 6 is a detail view of a preferred technique for positioning and securing the metal sheeting on the table; and FIG. 7 and FIG. 7*a* are partial detail views on line 7—7 of FIG. 3 illustrating a preferred technique for mounting the legs to the table and bench frames.

Referring now to FIGS. 1 and 4 of the drawing, the table of this invention is generally illustrated by reference numeral 1. The table top is generally illustrated by reference numeral 2, with ends 3, sides 4 and metal sheeting 5. As illustrated in FIG. 4 of the drawing, metal sheeting 5 is placed over table top frame members 10, which have been welded together, and is then secured to table top frame members 10, preferably by means of rivets 20. In like manner, the benches, generally illustrated by reference numeral 7, are built of bench frame members 11, illustrated in FIG. 4 of the drawing, and metal sheeting 5, which is also preferably secured to bench frame members 11 by means of rivets 20. Bench frame members 11 are likewise preferably secured by means of welding prior to application of metal sheeting 5.

Referring now more particularly to FIGS. 5 and 7 of the drawing, legs 12 are secured to table top 2 and to benches 7 by means of bolts 17, nuts 18 and washers 19, which cooperate to secure legs 12 to table top frame members 10 and bench frame members 11, as illustrated. The ends of braces 16 are first flattened and one end is then bolted to legs 12, while the other end is bolted to table top frame members 10, as illustrated, to impart stability to table 1.

It will be appreciated from additional consideration of FIGS. 1 and 2 of the drawing, that the configuration of legs 12 is very important to achieve optimum stability and strength of table 1. For example, it has been found by extensive experimenting that the angles of first bend 13, second bend 14, and third bend 15 are critical to such optimum stability and strength. It has been found that first bend 13 is preferably maintained in the range of from about 25° to about 55°, and second bend 14 should be about 90°. Likewise, third bend 15, perhaps the most critical of the three, should be about 100°. The critical nature of third bend 15 is particularly apparent because of the frequently encountered situation of loading one of benches 7 without a counter load on the opposite bench. For example, persons will frequently sit on one of the two benches of such a table without any regard or consideration of stabilizing the table by loading the other bench. Consequently, conventional tables have tipped, spilling the occupants, and caused injury because of the moment created by improper design of the table legs. However, because of the particular angles of first bend 13, second bend 14, and particularly third bend 15, either one of the two benches 7 can be completely loaded when no opposite and counterbalancing load is placed on the opposite bench, without danger of tipping table 1. The reason for such stability is apparent by a close consideration of FIG. 2 of the drawing. For example, loading of the left hand bench 7 effects a downward force in the approximate center of the bench as indicated by arrow 21. This load is directed along a line to the right of third bend 15 and the pivot point of table 1 for such a load application. Accordingly, there is no danger of tipping table 1 since there can be no torque exerted to effect such a tipping. Furthermore, because of the spread of legs 12 by application of first bend 13 at the point where legs 12 join top 2, and due to the common bracing effect of legs 12 with respect to table top 2 and benches 7, a load placed on table top 2, whether at the edge or at the center, will not cause the table to tip. Application of first bend 13 to effect this spread of the load also provides maximum strength in resistance to point or total loading on all portions of top 2. Accordingly, the objective of great strength and stability combined in a single structure has been achieved by the application of this invention and the safety of the table is greatly enhanced.

It will be appreciated by those skilled in the art that since the table of this invention is preferably constructed of metal, measures should be taken to make it rust resistant. Accordingly, legs 12 and braces 16, along with table top frame members 10 and bench frame members 11 are preferably zinc treated or painted to resist corrosion. In like manner, metal sheeting 5 is preferably formed onto table top frame members 10 and bench frame members 11 after receiving a baked-on coating of a selected color in order to minimize corrosion. Furthermore, rivets 20 and bolts 17, nuts 18 and washers 19 should be zinc coated or otherwise treated to minimize corrosion.

While it will be appreciated that table top frame members 10, bench frame members 11, legs 12 and braces 16 may be formed of metal members having substantially any shape, it is preferred, and has been found most expedient from both a cost and strength standpoint, to use the following materials in constructing the table of this invention: Table top frame members 10 and bench frame members 11 are preferably formed of 1 inch, 16 guage square tubing which is positioned as illustrated in FIG. 4 of the drawing, and preferably welded to form a frame of high strength. Legs 12 are preferably formed of 1¾ inch outside diameter, 14 guage, round mechanical tubing, which exhibits good bending characteristics with high retention of strength. The two braces are preferably constructed of 1.315 outside diameter, 17 guage, round mechanical tubing, flattened at either end to permit bolting to legs 12 and table top frame members 10, as illustrated in the drawing. Furthermore, metal sheeting 5 is preferably formed from roll sheeting, 36 inches in width, and as previously described, prepainted with a baked-on enamel finish to provide corrosion resistance.

The table of this invention is preferably about 27 inches high, and top 2 is preferably about 32 inches wide, while benches 7 are about 11 inches wide. The table (both benches and top) is preferably about 72 inches long. Accordingly, in the process of covering the table and bench frames, and referring again to FIGS. 4 and 6 of the drawing, metal sheeting 5, which is preferably 24 guage material, is first placed on table top frame members 10 and bench frame members 11 in 36 inch and 14 inch strips, both 76 inches long, respectively. Metal sheeting 5 is then trimmed at all corner edges at a 45° angle to permit folding under table top frame members 10 and bench frame members 11, as illustrated in FIG. 4 of the drawing. The sheeting is subsequently bent around the edges of table top frame members 10 and bench frame members 11 as shown in FIG. 6. The folded portion on the underside of top 2 and benches 7 is then secured in place, preferably by rivets 20. The folding and securing of metal sheeting 5 by means of rivets 20 is particularly illustrated in FIG. 6 of the drawing.

Having described my invention with the particularity set forth above, what is claimed is:

1. A table comprising:

a. A horizontally disposed first metal frame covered with a first metal sheeting;

b. A pair of horizontally disposed second metal frames, each covered with a second metal sheeting, said second metal frames being disposed on either side of, below, and essentially parallel to said first metal frame;

c. Two sets of metal legs, each of said sets being disposed at the opposite ends of and beneath said first metal frame and said second metal frames, each of said metal legs having a first intermediate portion disposed perpendicular to said first metal frame and a second intermediate portion disposed parallel to said first metal frame, one end portion of each of said metal legs being bent from the outer end of said first intermediate portion at an angle of from about 55 degrees to about 65° with respect to the vertical and attached to said first metal frame and the opposite end portion of said metal legs being bent inwardly from the outer end of said second intermediate portion toward said one end portion at an angle of about 10° with respect to the vertical and attached to said second metal frames, respectively; and d. a pair of braces, one end of each of which is carried by one of said sets of legs and the opposite end of which is carried by said first metal frame.

2. The table of claim 1 wherein said first and said second metal sheeting are folded around the periphery of said first metal frame and said pair of second metal frames, respectively, and riveted in place.

3. The table of claim 1 wherein said legs and said braces are attached to said first metal frame and said second metal frames by bolts.

4. The table of claim 1 wherein:

a. said first and said second metal sheeting are folded around the periphery of said first metal frame and said pair of second metal frames, respectively, and riveted in place; and b. said legs and said braces are attached to said first metal frame and said second metal frames by bolts.

5. The table of claim 1 wherein said first metal frame and said pair of second metal frames are characterized by peripheral members with interior cross braces welded to said peripheral members, and are formed of square metal tubing to form said first metal frame and said second metal frames, and said legs and braces are formed of round metal mechanical tubing.

6. The table of claim 1 wherein:

a. Said first and said second metal sheeting are folded around the periphery of said first metal frame and said pair of second metal frames, respectively, and riveted in place;

b. Said legs and said braces are attached to said first metal frame and said second metal frames by bolts; and c. Said first metal frame and said pair of second metal frames are characterized by peripheral members with interior cross braces welded to said peripheral members and are formed of square metal tubing to form said first metal frame and said second metal frame, and said legs and braces are formed of round metal mechanical tubing.

7. The table of claim 1 wherein:

a. said first metal sheeting and said second metal sheeting are painted with a baked-on, corrosion-resistant finish.

8. The table of claim 1 wherein:

a. Said first and said second metal sheeting are folded around the periphery of said first metal frame and said pair of second metal frames, respectively, and riveted in place;

b. Said legs and said braces are attached to said first metal frame and said second metal frames by bolts;

c. Said first metal frame and said pair of second metal frames are characterized by peripheral members with interior cross braces welded to said peripheral members and are formed of square metal tubing to form said first metal frame and said second metal frames, and said legs and braces are formed of round metal mechanical tubing; and d. Said first metal sheeting and said second metal sheeting are painted with a baked-on, corrosion-resistant finish.

* * * * *